US006112892A

United States Patent [19]

Thibaud

[11] Patent Number: 6,112,892

[45] Date of Patent: Sep. 5, 2000

[54] BOX FOR A PACK OF CIGARETTES

[76] Inventor: Joël Thibaud, Les Forges, St. Supplice le Verdon, France

[21] Appl. No.: 09/249,576

[22] Filed: Feb. 12, 1999

[51] Int. Cl.[7] ..... B65D 85/12

[52] U.S. Cl. ..... 206/242; 206/273; 206/276

[58] Field of Search ..... 206/242, 245, 206/246, 248–252, 271, 276, 273

[56] References Cited

U.S. PATENT DOCUMENTS

| | | | |
|---|---|---|---|
| 381,889 | 4/1888 | Scott | 206/254 |
| 512,011 | 1/1894 | Colgan | 206/254 |
| 2,807,358 | 9/1957 | Zion | 206/90 |
| 2,811,247 | 10/1957 | Stevenson | 206/90 |
| 4,997,082 | 3/1991 | Durocher | 206/242 |
| 5,205,403 | 4/1993 | DeBlasio | 206/273 |
| 5,301,805 | 4/1994 | Evers et al. | 206/273 |
| 5,363,955 | 11/1994 | Fleenor | 206/273 |
| 5,570,779 | 11/1996 | Draucker et al. | 206/273 |

*Primary Examiner*—Paul T. Sewell
*Assistant Examiner*—J. Mohandesi
*Attorney, Agent, or Firm*—Young & Thompson

[57] ABSTRACT

A box (1) for a pack of cigarettes has the shape of a hollow body dimensioned to receive a pack of cigarettes, the hollow body being delimited by at least four surfaces (2, 3, 4, 5) forming the walls of the body and a surface (6) forming a bottom constituted by a prolongation of one wall of the body and connected to that one wall by a bend line (7). The surface (6) forming the bottom of the body is prolonged by a flap (8) connected to the surface forming the bottom by a bend line (9) permitting positioning substantially at a right angle the flap relative to the surface (6) forming the bottom. The flap (8) has the form of a flexible dihedral with at least two legs (8A, 8B) of variable geometry, at least one (8B) of the legs (8A, 8B) of the dihedral being inserted within the body between a wall (17A) of the pack of cigarettes (17) and a wall (5) of the box so as to maintain the surface (6) forming the bottom of the body in closed position of the body. The internal surface of this surface (6) forming the body is provided with a substantially flat object (10), disposed in a hidden manner between the surface (6) forming the bottom of the box and the bottom (17B) of the pack of cigarettes (17) in the closed condition of the surface (6) forming the bottom.

8 Claims, 3 Drawing Sheets

BOX FOR A PACK OF CIGARETTES

FIELD OF THE INVENTION

The present invention relates to a box for a pack of cigarettes.

It relates more particularly to a box of the type having the shape of a hollow body so dimensioned as to receive a pack of cigarettes, this hollow body being delimited by at least four faces forming the walls of the body and a face forming the bottom, constituted by a prolongation of one wall of the body and connected to this latter by a bend line.

BACKGROUND OF THE INVENTION

Boxes to receive a pack of cigarettes have already been generally described in the literature. These boxes are generally adapted to receive a lighter to permit the smoker to have simultaneously cigarettes and fire. Such a box is particularly described in the patent FR-A-2.753.605. In this document, the box comprises a small side provided with an opening permitting inserting a lighter which is thus maintained between the bottom of the pack and the bottom of the box. A recess and/or a window are provided in the bottom of the box to withdraw the lighter by pressing it rearwardly or by sliding it with the finger.

Another design of box, belonging to the prior art of the present invention, is also described in the patent FR-A-2.741.511.

None of these boxes described until now permits hiding completely the element disposed within the box.

SUMMARY OF THE INVENTION

An object of the present invention is to provide a box for a pack of cigarettes whose design permits receiving in a hidden and safe manner, a flat element within the box whilst permitting easy extraction of the object thus disposed in the box.

To this end, the invention has for its object a box for a pack of cigarettes, of the type having the shape of a hollow body so dimensioned as to receive a pack of cigarettes, said hollow body being delimited by at least four surfaces forming the walls of the body and a surface forming the bottom constituted by a prolongation by one wall of the body and connected to this latter by a bend line, characterized in that the surface forming the bottom of the body is prolonged by a flap connected to the surface forming the bottom by a bend line permitting positioning at a substantially right angle the flap relative to the face forming the bottom, this flap having the form of a flexible dihedral, with at least two legs, of variable geometry, at least one of the legs of the dihedral being inserted within the body between one wall of the pack of cigarettes and one wall of the box so as to maintain the surface forming the bottom of the body in the closed condition of the body, the internal surface of this surface forming the bottom being provided with a substantially flat object, preferably a packaged condom, disposed in a hidden manner between the surface forming the bottom of the box and the bottom of the pack of cigarettes in the closed condition of the surface forming the bottom.

According to a preferred embodiment of the invention, the two legs of the dihedral with variable geometry that constitute the flap are inserted between the wall of the box and the wall of the pack of cigarettes, the variable geometry design of the dihedral facilitating this insertion, in particular in the case of long arms.

BRIEF DESCRIPTION OF THE DRAWINGS

The invention will be understood from the following description of examples of embodiment, with reference to the accompanying drawings, in which.

DETAILED DESCRIPTION OF THE INVENTION

Figure 4:
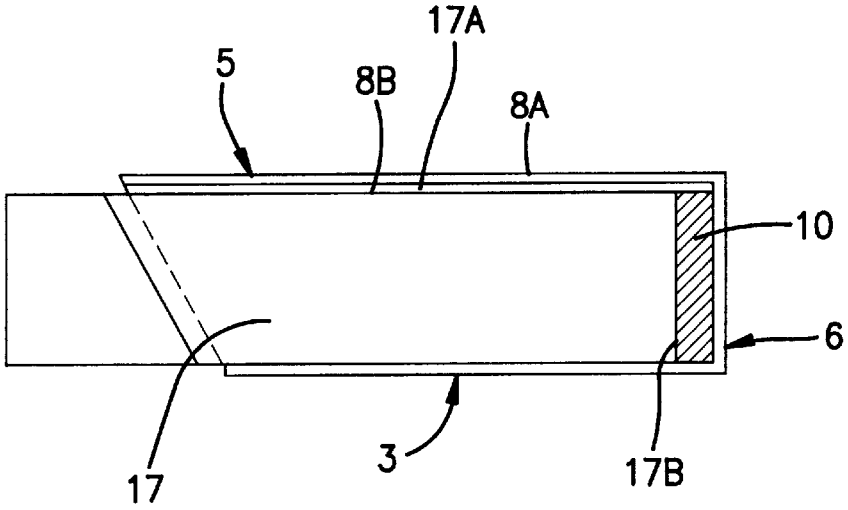
FIG. 4 is a cross-sectional view of the box in the closed condition, the pack of cigarettes being disposed within said box.

The box for a pack of cigarettes, according to the invention, is shown generally by reference numeral 1 in the figures. This box, in the made-up condition has the shape of a hollow body dimensioned to receive a pack of cigarettes 17 such that, when inserted, the bottom 17A of the pack of cigarettes 17 is disposed facing the surface 6 forming the bottom of the body as shown in FIG. 4. This hollow body, of generally parallelepipedal shape, is delimited by at least four surfaces represented at 2, 3, 4, 5 in the figures. These surfaces form the walls of the body. This hollow body also comprises a surface 6 forming a bottom constituted by a prolongation of one wall of the body. This surface 6 forming the bottom is connected to one wall of the body, in this instance the wall 3 of the body, by a bend line 7.

Figure 1:
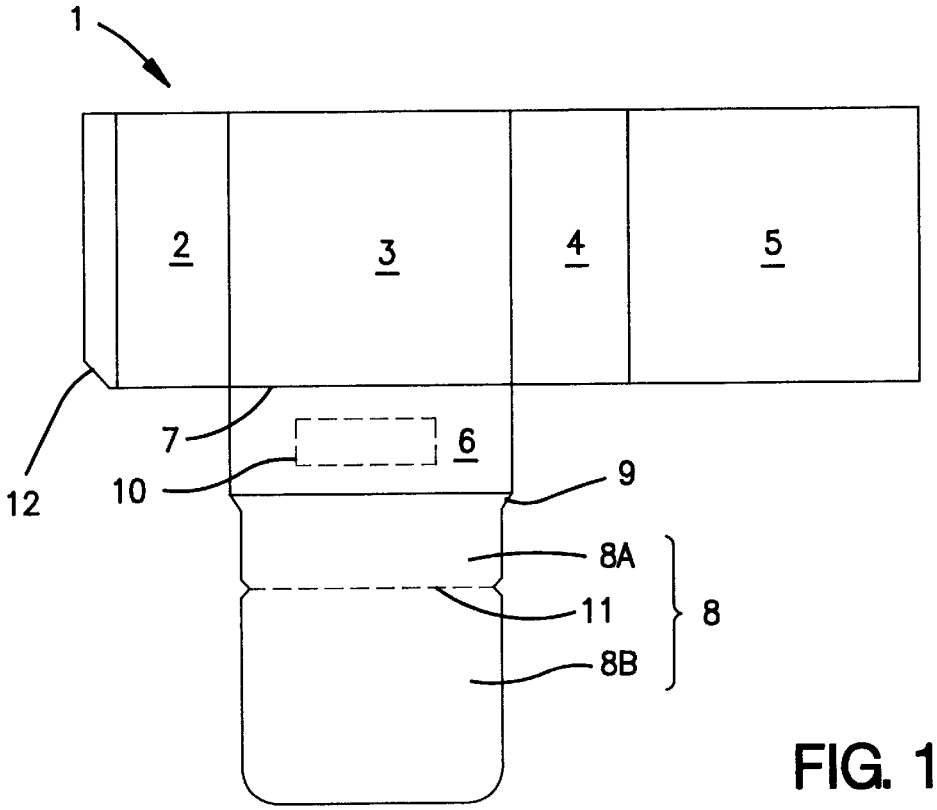
FIG. 1 is a plan view of a blank adapted to form in the bent, grooved and glued condition, a box according to the invention.
Figure 3:
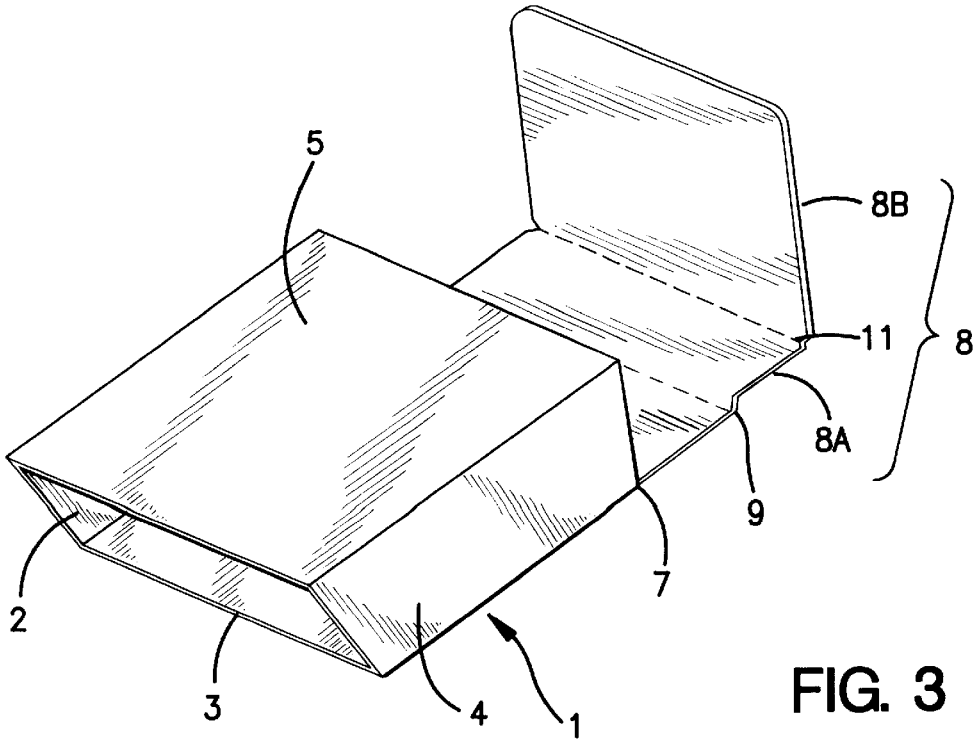
FIG. 3 is a perspective view of the box obtained from the blank of FIG. 1 in the condition in which the bottom of the box is not closed.
Figure 2:
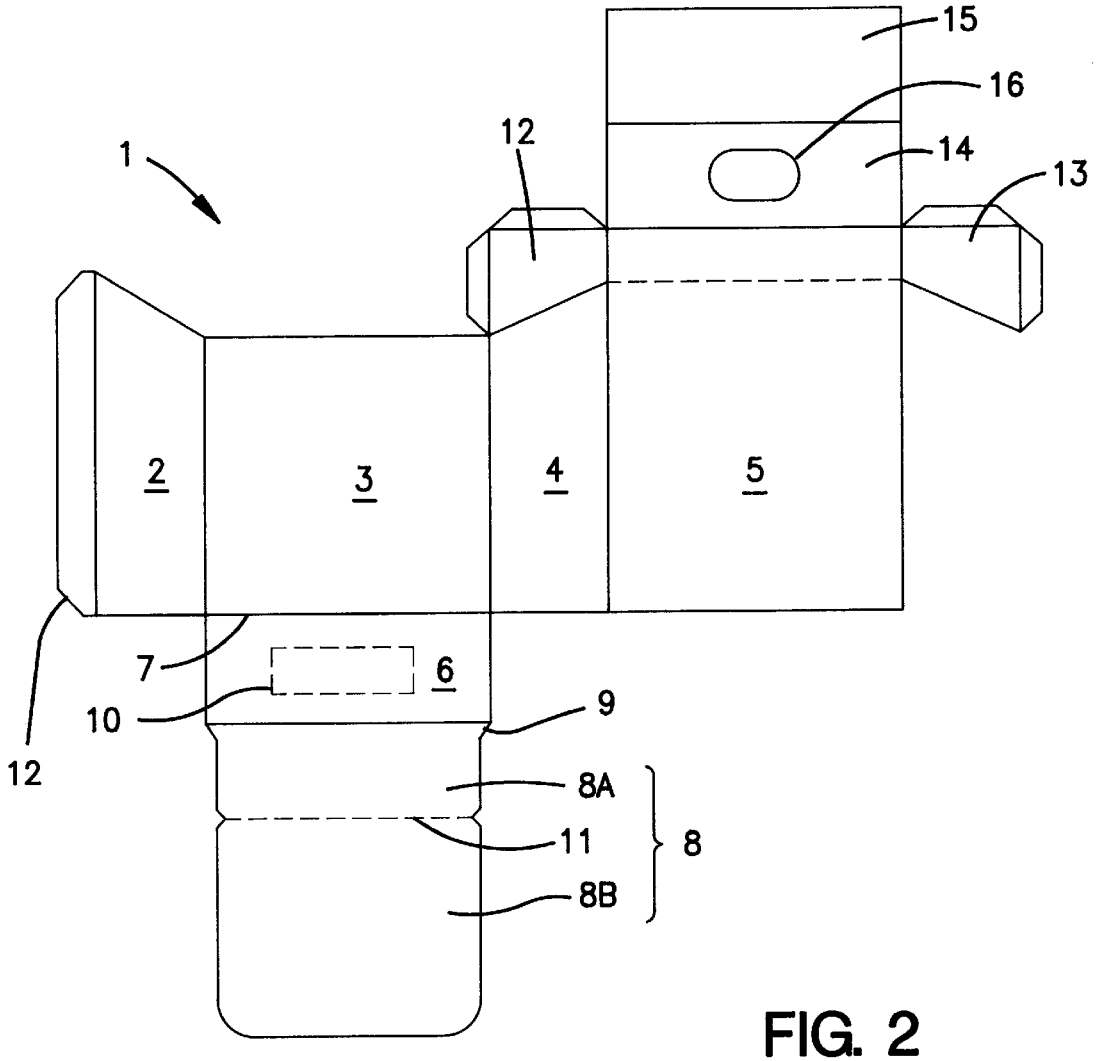
FIG. 2 is a plan view of another embodiment of a blank permitting the production of a box according to the invention.

Generally speaking, the surface 6 forming the bottom of the body and the walls 2, 3, 4, 5 of the body, constituting respectively the rear surface 5 of the body, the front surface 3 of the body parallel to the rear surface 5 and the side surfaces 2, 4 of the body necessary for the rigidification and the setting up of the body, are obtained from a single blank, generally of cardboard, scored, bent and glued. The surface 6 forming the bottom of the body constitutes preferably a prolongation of the front surface 3 or the rear surface 5 of the body. Such examples of blanks are shown in FIGS. 1 and 2. Generally speaking, one of the walls of the body comprises a gluing flap shown at 12 in FIG. 1. The scoring, the bending and the gluing of such a blank present no difficulty for those skilled in the art. Because of this, in the glued condition, such a hollow body has, in transverse cross-section, the shape of a parallelogram, this parallelogram deforming upon setting up of the box to pass from a flattened position permitting flat storage of said box to a set-up position in which it permits the reception of a pack of cigarettes 17.

The surface 6 forming the bottom of the body is prolonged by a flap 8 characteristic of the invention. This flap 8 is connected to the surface 6 forming the bottom of the body by a bend line 9 permitting positioning at substantially a right angle the flap 8 relative to the surface 6 forming the bottom. This flap 8 has the shape of a flexible dihedral, with at least two legs 8A, 8B, of variable geometry. By a flap having the shape of a flexible dihedral of variable geometry, is meant a flap whose legs of the flexible dihedral can be positioned variably, which is to say spaced from each other by a variable distance to form any angle between them because of the possibility of the legs to move angularly about their common bend line 11. To form the bottom of the body, at least one 8B of the legs 8A, 8B of the flexible dihedral is inserted within the body between a wall 17A of the pack of cigarettes 17 and a wall 5 of the box so as to maintain the surface 6 forming the bottom of the body in the closed position of the body.

Two embodiments of such a flap can be envisaged. In a first embodiment, according to FIGS. 1 to 4, the two legs 8A, 8B of the flexible dihedral of variable geometry which constitute the flap 8 are inserted between the wall 5 of the box and a wall 17A of the pack of cigarettes 17, the design with variable geometry of the dihedral facilitating this insertion, in particular in the case of long leg lengths. Thus, it is preferable that the two legs of the dihedral have a length substantially equal to the length of one wall of the box when they form between them an angle equal to 180 degrees. This permits guaranteeing with certainty the securement of the surface forming the bottom in the closed condition of the body.

Figure 5:
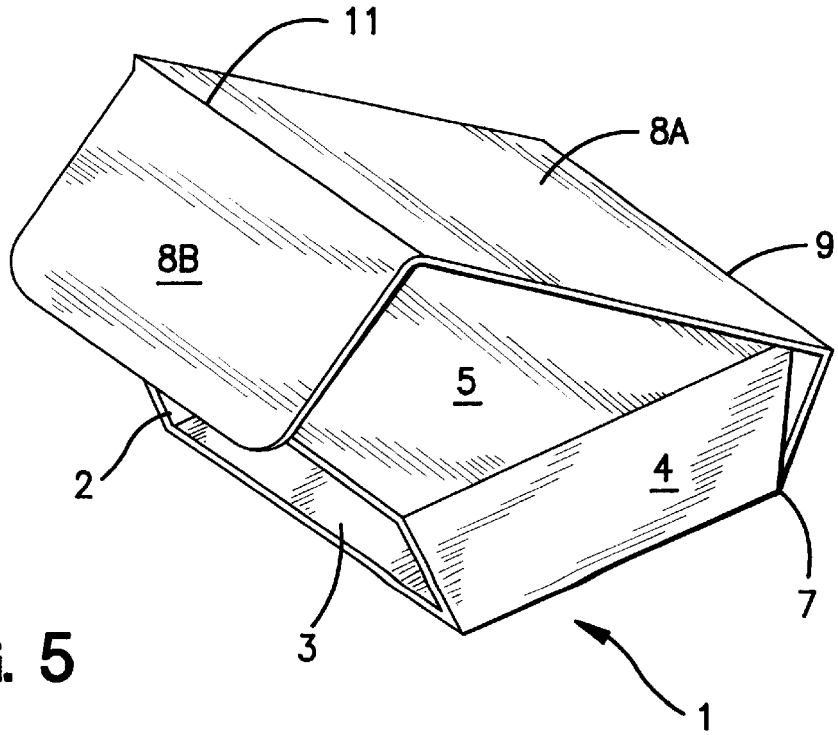
FIG. 5 is a perspective view of another embodiment of box in the partially closed condition of the bottom of the box.

In another embodiment of the invention shown in FIG. 5, the first leg 8A of the dihedral which constitutes the flap 8 is connected to the surface 6 forming the bottom of the body by a bend line 9, and is bent outwardly of the body substantially at a right angle to the surface 6 forming the bottom to form a doubling of a wall of the body, in this instance the wall 5 in the illustrated embodiments. The second leg 8B of the dihedral, arranged in prolongation of the first leg 8A of the dihedral, forms a return adapted to be bent within the body against this same wall 5 of the body. The second leg 8B of the dihedral is maintained in a position applied against said wall 5 of the body by a wall 17B of the pack of cigarettes 17 contained in the body. This flap is hence comprised in the two above embodiments in a manner analogous to each other by constituting each time a flexible dihedral whose two legs can be given relative movement, one relative to the other, and are displaceable angularly to form any angle between them. Only the dimensions of the legs are modified between the first and second embodiment of the invention. Thus, if the blank of a box shown in FIG. 5 had been shown, it would be identical to that of FIG. 1 except for the dimensions of the surfaces 8A and 8B, the surface 8B corresponding at least to the dimensions of the wall 3 or 5 of the body whilst the surface 8B of a size less than that of surface 8A is dimensioned to bend easily within the body of the box.

In the two above embodiments, the legs 8A and 8B of the dihedral constituting the flap can be separated from each other by means of a bend line 11 comprising punchings, for example perforations, to permit easy detachment of the leg 8B from the free end of the flexible dihedral. Thus, this second leg 8B of the flexible dihedral can for example comprise printed elements, such as a notice of use.

The internal surface of the surface 6 forming the bottom of the body is moreover provided with a substantially flat object 10, preferably a packaged condom, disposed in hidden fashion between the surface 6 forming the bottom of the box and the bottom of the pack of cigarettes in the closed condition of the surface 6 forming the bottom. Such an object 10 has been shown in broken line in FIG. 1 and by cross-hatching in FIG. 4. This condom 10 is secured to the internal surface of the surface 6 forming the bottom of the box generally by gluing with a single point of glue. In the case in which this condom must be removed from the box, it suffices, in the first embodiment of the box described above, to exert a pull on the surface 6 forming the bottom of the box so as to extract the flap 8 from its recess provided between the wall 17B of the pack of cigarettes 17 and a wall 5 of the body of the box. Even partial extraction of the flap 8 from its recess suffices to give access to the condom 10 and to detach this latter from the internal surface of the surface 6 forming the bottom of the box. This extraction can be carried out in a discrete manner.

In the second embodiment (FIG. 5) of the above box, it is necessary, on the contrary, to remove the pack of cigarettes from the box to free the second leg 8B of the flexible dihedral, to unfold this second leg 8B of the flexible dihedral and then to unfold the first leg 8A of the flexible dihedral so as to have access to the internal surface of the surface 6 forming the bottom of the box. In the same manner, the condom 10 can then be detached from this surface 6 forming a bottom.

The upper surface of the body of the box, opposite the surface 6 forming the bottom of this box, can be made according to a large number of embodiments. A first embodiment, according to FIG. 1, and corresponding to the simplest embodiment, consists in leaving this upper surface open.

A second embodiment as in FIG. 2, consists in providing a cover connected pivotally by means of a bend line to one of the walls of the body to permit pivotal displacement of the cover relative to said body. This cover will generally have a shape analogous to the cover of cigarette packs. Such a cover 12, 13, 14, 15 is shown in FIG. 2 and will not be described in a detailed manner as it is shaped like those provided in the case of the production of packs of cigarettes. It is to be noted that this cover could be provided with an opening 16, if desired covered with an adhesive. Thus, the box, once emptied of the object it hides, in particular of the condom, can then be used as an ashtray.

What is claimed is:

1. A box comprising four walls and a bottom, said box having the shape of a hollow body dimensioned to receive a pack of cigarettes, the bottom of the box extending from one wall of the box and connected to said one wall by a bend line, such that when inserted, a bottom of the pack of cigarettes is disposed facing an internal surface of the bottom of the box; the hollow body having in transverse cross-section the shape of a parallelogram which deforms when the box is set up to pass from a flattened position for permitting flat storage of said box, to a set-up position for receiving the pack of cigarettes; a flap extending from and connected to the bottom of the box by a bend line for positioning the flap substantially at a right angle relative to the bottom of the box; said flap having the form of a flexible dihedral with at least two legs of varying geometry; said two legs being structured and arranged to be inserted within the body between a wall of the pack of cigarettes and a first wall of the box so as to maintain the bottom of the box in a closed position; the internal surface of the bottom of the box having a substantially flat object disposed thereon, such that in the set-up position the object is between the internal surface of the bottom of the box and the bottom of the pack of cigarettes, whereby access to said object is effected by a pull exerted on the bottom of the box so as to extract at least partially the flap inserted between said wall of the pack of cigarettes and said first wall of the box.

2. The box according to claim 1, wherein the legs of the flexible dihedral constituting the flap are separated from each other by a bend line having perforations.

3. The box according to claim 1, wherein the bottom and the four walls of the box are obtained from a single blank, scored, folded and glued; the bottom constituting an extension of one of a front surface and a rear surface of the body.

4. The box according to claim 1, wherein said flat object is secured to the internal surface of the bottom of the box with glue.

5. A blank for producing a hollow body having a front, a rear, a first side, an opposite second side, and a bottom; the blank comprising a rectangular first panel joined to a rectangular second, third and fourth panel at a first, second and third fold line, respectively; and a rectangular fifth panel joined at a fourth fold line to said third panel; said fourth panel being joined to a flexible flap at a fifth fold line; said flap being comprised of a rectangular first leg joined to a rectangular second leg at a bend line; said first, second and fourth fold lines being parallel and extending from a first blank edge to an opposite second blank edge; said third fold line, fifth fold line, and bend line being parallel to said first blank edge; said panel being structured and arranged to fold along respective fold lines such that in a folded mode said first panel forms the front, said second panel forms the first side, said third panel forms the opposite third side, said fourth panel forms the bottom, said fifth panel forms the rear of the hollow body, and said flap being substantially perpendicular to said bottom; said hollow body being dimensioned to receive a pack of cigarettes; said fourth panel having a flat object disposed thereon such that in use, when the pack of cigarettes is inserted within the hollow body, said flat object is hidden within the body below the pack of cigarettes, and the flap is positioned within the body between a wall of the pack of cigarettes and the rear of the hollow body; and said object being accessible by pulling on the bottom so as to at least partially extract said flap from the hollow body.

6. The blank according to claim 5, wherein the bend line joining the first and second leg has perforations.

7. The blank according to claim 5, wherein the flat object is secured to the fourth panel with glue.

8. The blank according to claim 5, wherein the second panel is joined to a gluing flap at a sixth fold line parallel to said first, second and fourth fold lines.

* * * * *